United States Patent [19]

Simpson et al.

[11] 4,414,756

[45] Nov. 15, 1983

[54] METHOD AND APPARATUS FOR TREATING STRAND-LIKE MATERIAL

[75] Inventors: Carroll Simpson, Greenville; Ludwig Schierl, Spartanburg, both of S.C.

[73] Assignee: American Hoechst Corporation, Somerville, N.J.

[21] Appl. No.: 316,581

[22] Filed: Oct. 30, 1981

[51] Int. Cl.[3] ..... F26B 3/04; F26B 13/12

[52] U.S. Cl. ..... 34/23; 34/24; 34/153; 34/157; 34/236; 68/5 D; 242/47.01

[58] Field of Search ..... 68/5 D, 5 E; 242/47.01, 242/47.13; 34/153, 157, 159, 161, 147, 236, 24, 23

[56] References Cited

U.S. PATENT DOCUMENTS 2,336,019 12/1943 Kline et al. .
2,388,591 11/1945 Andreas .
2,639,485 5/1953 Ambler .
3,217,482 11/1965 Baer .
3,774,384 11/1973 Richter ..... 68/5 D
4,316,370 2/1982 Steiner ..... 68/5 D

*Primary Examiner*—L. I. Schwartz
*Attorney, Agent, or Firm*—Leonard S. Selman; James C. Lydon

[57] ABSTRACT

An improved method and apparatus for treating strand-like material is described. The method comprises conveying loops of such strand-like material supported by conveyor means through a heating zone wherein provision is made for causing certain portions of said loop material to experience substantial peripheral sliding movement in their contact with and with respect to said conveyor means, which movement has been found to reduce irregularities in the subsequent dyeing of the strand-like material.

13 Claims, 6 Drawing Figures

METHOD AND APPARATUS FOR TREATING STRAND-LIKE MATERIAL

BACKGROUND OF THE INVENTION

1. Field of the Invention

This invention is directed to a method and apparatus for treating strand-like material, and more particularly for heat setting such material to provide for the shape retention of the material.

2. Description of the Prior Art

An example of the above-mentioned material shape retention is the ability of a heatset textile carpet yarn to resist crushing by springing back to shape when walked upon for a much longer time than a non-heatset carpet yarn. To obtain this kind of advantage, the heat setting of the material may take place in apparatus of the type generally described in U.S. Pat. No. 3,683,650, issued Aug. 15, 1972. In the operation of such apparatus, the strand-like material such as yarn is laid in loops in a type of spiral coil about conveyor means in the form of a plurality of narrow conveyor belts or ropes arranged at corners of the loops to transport the loops downstream to a heating zone. While in U.S. Pat. No. 3,683,650 apparatus is provided to rotate the coil carrying conveyor ropes while in the heating zone, it has been found that this is not necessary in all instances and in fact, in the description and examples set forth herein, the conveyor ropes were not rotated. While in the heating zone wherein the coil material is heat set, it has been found that due to the contact between the loops and the ropes as the loop material shrinks during the heat setting thereof, certain damage or non-uniform conditioning has been caused to the loop material such that in a subsquent dyeing operation irregularities occur. In particular, when the loop material has been heat set as described above and manufactured into a carpet during a tufting operation and is then dyed using conventional dyeing equipment, upon visual observation a pattern of light flecks are perceived on the surface of the dyed carpet in a scattered pattern. In a piece of carpet dyed brown, for example, the flecks appeared beige in color and are so numerous as to be unacceptable to the customer. Thus, a method and apparatus for overcoming this problem is desired.

SUMMARY OF THE INVENTION

This invention is directed to a method and apparatus for treating strand-like material and more particularly, for heat treating such material to provide for the improved shape retention of the material.

A particular aim of the invention is the overcoming of problems of irregularities in dyed carpet made from strand-like material which has been heatset. To overcome such problems which have been identified with the type of heat treating apparatus wherein loops of the strand-like material are conveyed by conveyor means through a heating zone wherein they are heat set, this invention comprises the method and means for causing certain portions of said loop material to experience substantial sliding movement as they are being conveyed through said heating zone and are experiencing shrinking.

BRIEF DESCRIPTION OF THE DRAWINGS

A more comprehensive understanding of the invention may be had by considering the following drawing in conjunction with the detailed description wherein.

DESCRIPTION OF THE PREFERRED EMBODIMENT

Figure 1:
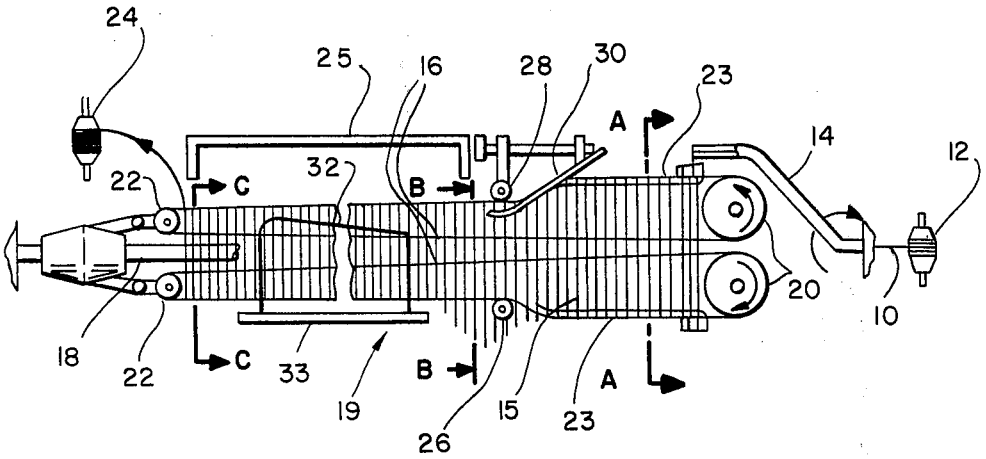
FIG. 1 is a schematic representation of a known heat treating apparatus including additional apparatus of the invention.
Figure 2:
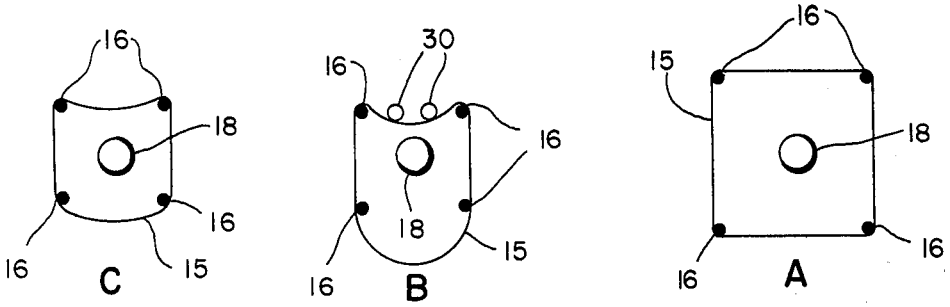
FIG. 2 is a schematic representation of the strand-like material as it is looped about a conveyor means in different positions as indicated in its travel downstream through the heat setting apparatus of FIG. 1.
Figure 3:
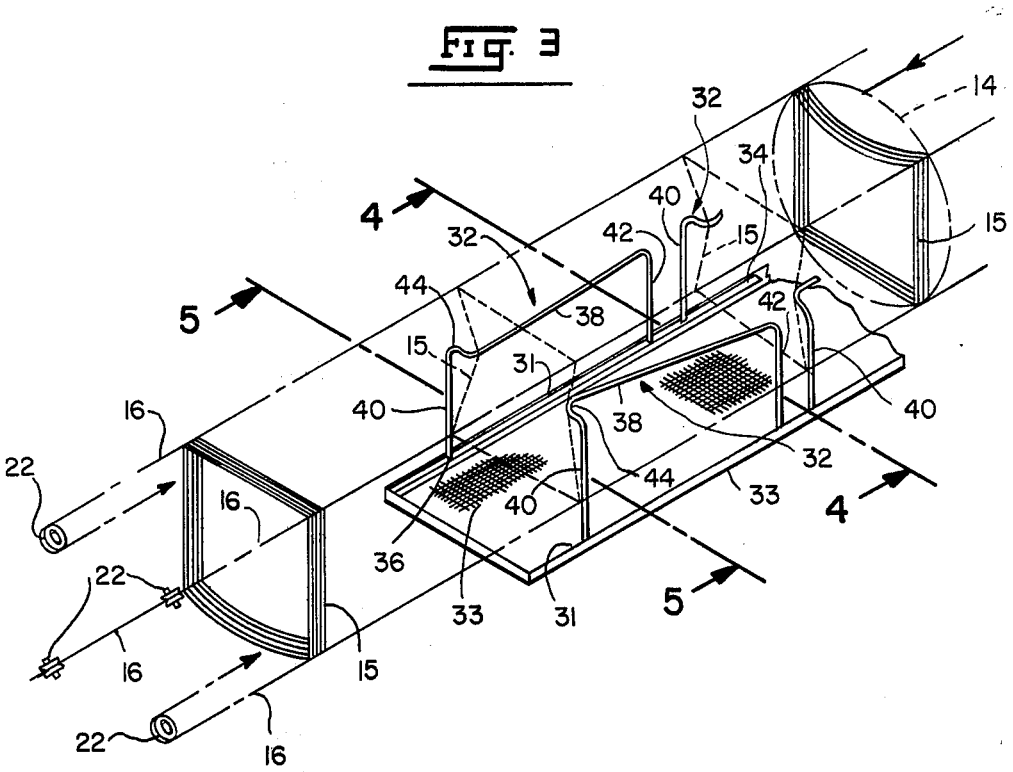
FIG. 3 is a perspective view of a preferred structure of the inventive apparatus for treating strand-like material in cooperative relationship with the known heat treating apparatus of FIG. 1.

Referring to FIG. 1, a strand-like material, e.g. a yarn, 10 is shown which is in operation drawn from a source such as spool 12 and passed through a yarn guide tube 14. The tube 14 is driven in a circular path by conventional motor belt driving means (not shown) and takes the material 10 from the spool 12 and lays it in loops 15 as shown in FIGS. 2 and 3 about longitudinally traveling conveyor means 16. The conveyor means comprise a plurality of narrow endless belt or ropes 16 and there are preferably four endless ropes 16 as schematically shown in FIGS. 1–3 which support the loops at four corners thereof (see FIG. 2A in particular). The loops 15 form a type of spiral coil which surround the conveyor ropes 16. The ropes 16 are mounted on a supporting mast 18 which extends the length of the heat treating device 19. Drive rollers 20 which drive the conveyor ropes 16 are also mounted on the mast 18 and are driven the direction of the arrows shown in FIG. 1 by conventional motor pully driving means.

Referring to FIGS. 1 and 3, the conveyor ropes 16 pass around the driven rollers 20 and further pass around pulleys 22 mounted at the downstream end of mast 18. Opposing sheet metal tracking guides 23 are provided to guide the ropes 16 in their initial stage of travel downstream from driven rollers 20. The ropes 16 engage the loops 15 of material 10 and move the loops 15 downstream through a heating chamber 25 where the material is exposed to heat, e.g., in the form of steam and/or hot air in order to heatset it. When the heat setting is completed the material is taken off the conveyor ropes 16 and wound on a spool 24 or other receptacle by means of a conventional motor pully driven winder.

After the material 10 is laid in loops 15 on the ropes 16 as shown in FIG. 1, the ropes 16 carry the loops 15 downstream toward the heating chamber 25. Due to the shrinkage experienced by the material 10 in the heat treating process, provision is made for allowing such heat shrinkage while still maintaining the required amount of tension of the loops 15 with respect to the rope conveying means 16. Thus, at the position in the downstream travel of the loops 15 where they are about to experience an initial amount of shrinkage, at least a pair of rope lifters 26 and at least a pair of rope depressors 28 are provided (the side not shown is identical to that shown) so that the rope conveyors 16 are properly positioned in closer spacial relationship to receive the loops 15 after they are shrunk. A yarn depressor 30 is also provided which causes a so-called "bag" in the loops 15 as they enter the heat shrinkage zone of their downstream movement.

FIG. 2 shows the loops 15 in various stages of their downstream movement. Thus, FIG. 2A shows the loops 15 at point A—A in FIG. 1, as they are looped around the conveyor means or ropes 16 in rectangular fashion. FIG. 2B shows the loops 15 at point B—B of FIG. 1 after they are contacted by yarn depressor 30 shown in FIG. 1. The depressor 30 causes a so-called "bag" in the loops 15 before they enter the heat shrinking zone. As shown by FIG. 2C taken along line C—C in FIG. 1, when the loops 15 leave the heating zone, the baggy loop has shrunk while maintaining proper contact with the rope conveying means 16.

It has been found that when material 10 is heat set utilizing the apparatus described above and is manufactured into a textile carpet and dyed in the conventional manner, a problem of irregular dyeing occurs. The problem is noticeable in the form of light flecks which are perceived in a scattered pattern on the darker carpet which flecks are so numerous as to be visually unacceptable to the customer. After investigation of the problem the present inventive method and apparatus was conceived and reduced to practice to solve the flecking problem. In particular it has been found that by causing a substantial peripheral sliding movement of the material of loops 15 with respect to the conveyor ropes 16 avoiding static or near static contact between the loops and conveyor ropes during the travel downstream of the loops through the heating zone of the heat treating apparatus the aforementioned flecking is reduced to an acceptable level. It is believed that some damage or conditioning occurs to portions of the loop material which are in static or near static contact with the conveyor ropes 16 while the shrinkage of the material is taking place during the exposure to heat for heat setting purposes. While the exact nature of the physical phenomena leading to the damage is not presently known the method and apparatus disclosed herein has demonstrably solved the problem in satisfactory manner by avoiding the aforesaid static or near static contact.

To provide for the substantial peripheral sliding movement of the loop material with respect to the conveyor ropes 16 guide means in the form of deflector guides 32 are provided in cooperative relationship with the heat treating apparatus of FIG. 1. The deflector guides 32 are shown in detail in FIGS. 3–6.

Figure 4:
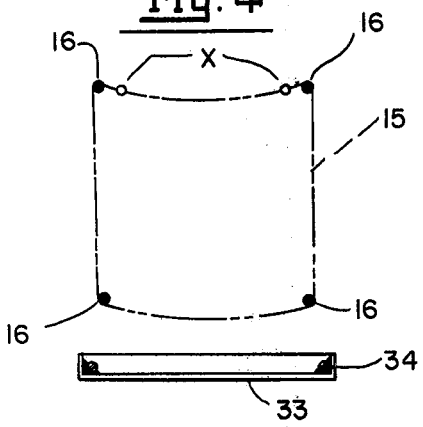
FIGS. 4 and 5 are companion partial sectional schematic views illustrating the interaction of the strand shaped material with the apparatus of FIG. 3.
Figure 5:
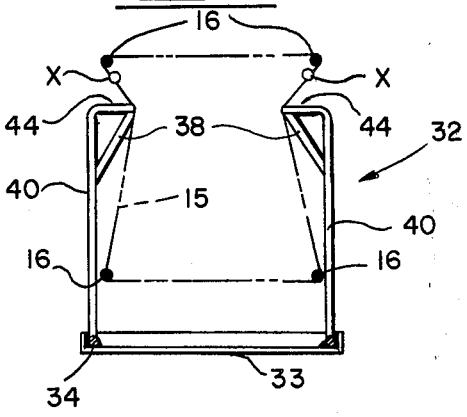

Shown in perspective in FIG. 3 the deflector guides 32 comprise shaped elements, e.g., bent stainless steel rods, which provide a rounded, camming surface for contacting the loops 15 of material 10 as they are conveyed by ropes 16 through the heating apparatus 19. The deflector guides 32 are preferably mounted on screen element 33 which is supported under the conveyor ropes 16 in the apparatus 19 to screen the air that circulates around the loops 15 in the heating zone 25 of apparatus 19. Mounting rods 34 are affixed, as by welding, along the side edges 31 of the screen element 33 as shown in FIGS. 3, 4 and 5, which mounting rods have apertures 36 therein at spaced intervals for insertion therein of the mounting legs 40 and 42 of deflector guides 32. Other means of mounting such deflector guides 32 or equivalent form of guide means may obviously be employed by those skilled in the art to accomplish the purposes of the invention.

Figure 6:
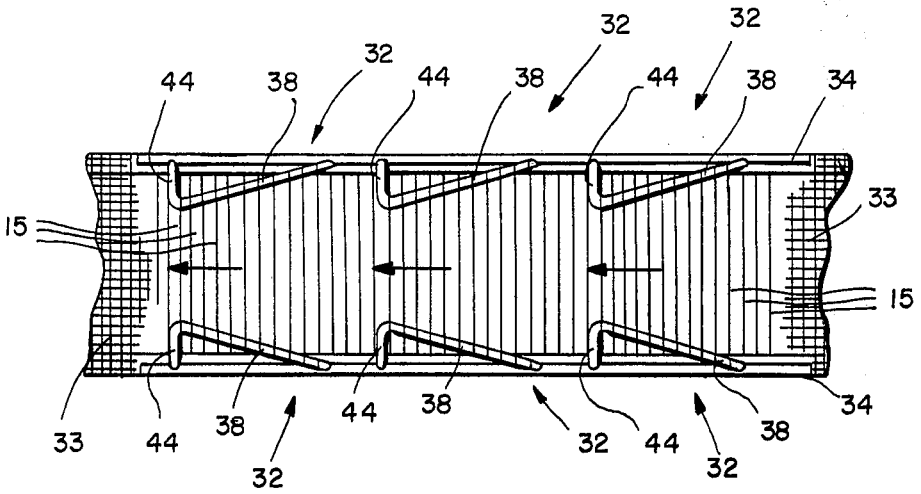
FIG. 6 is a top plan view of several opposed pairs of strand-like shaped material contacting deflector guides of the apparatus of FIG. 3.

Referring to FIGS. 3 and 6, the deflector guides 32 comprise a loop contacting portion 38, preferably about 18 inches long and a plurality, e.g., two mounting legs 40 and 42, preferably about 11.25 and 8.125 inches, respectively. A substantially horizontal portion 44 of the deflector guides preferably of about 2.375 inches in length connects leg 40 with the portion 38 to space it inwardly in the direction of the passing loops 15 when in use.

In practice two of the deflector guides 32 are mounted opposite one another on the sides of screen 33 as shown in FIGS. 3, 5 and 6. It has been found that there are advantages to providing a plurality of pairs of deflector guides 32 along the length of screen element 33 each mounted thereon in the described manner. Thus, as shown in FIG. 6 as many as three or more opposing pairs of deflector guides 32 are utilized. As the loops 15 travel downstream in the heating zone 25 of the apparatus 19 they pass between the opposing deflector guides 32 are shown most clearly in FIGS. 4, 5 and 6. The periphery of each loop as shown in FIGS. 4 and 5, for example, traces a substantially rectangular pattern as it is supported on conveyor ropes 16. As each loop moves downstream it first comes into contact with the loop contacting portions 38 of deflector guides 32 and the shape of the loop 15 is distorted as shown in FIG. 5. As compared to FIG. 4, for example, any one portion of loop material will thus move or slide from one peripheral position to another on the circumference of the loop as the loop shape is more or less distorted depending upon its downstream position in relation to the loop contacting portion 38 of deflector guides 32. This is shown most clearly in FIG. 4 taken along line 4—4 in FIG. 3 wherein the loop 15 is not in contact with loop contacting portion 38 and point X is shown on the peripheral top portion of the loop periphery. In FIG. 5 taken along line 5—5 of FIG. 3 the loop 15 has moved downstream to a position where the loop contacting portion 38 is markedly distorting the peripheral shape of loop 15 and point X as a result has experienced substantial peripheral sliding movement in the range of 1 to 2 inches with respect to the conveyor rope 16 until it has been displaced to a position on the other side of conveyor rope 16 to a position on the side of the loop 15. It is apparent that, depending upon its position on the loop, some portions of loop material will move into and out of contact with conveyor rope 16 during its peripheral sliding movement while others will not; however, no one portion will stay in static or near static contact with any one portion of the conveyor ropes 16 during its travel downstream due to the loop contacting action of the deflector guides 32. When a plurality of deflector guides 32 are arranged in sequential opposed pairs as shown in FIG. 6 the loops 15 will be first contacted with one deflector guide 32 and then the loop 15 will be out of contact and thus not be subject to the distortion of its peripheral shape until it reaches and is contacted by the next deflector guide 32 in its downstream movement wherein the desired peripheral sliding movement is repeated.

Many different kinds of yarn and fibers may be processed in this type of heat treating apparatus including nylon and polyester yarn, both types of yarn commonly being used for the manufacture of carpeting. Polyester yarns were of special interest to the developer of the subject invention and the examples given below were carried out utilizing polyester yarn.

To determine the effectiveness of the inventive method and apparatus, a test was performed wherein polyester carpet yarn was heat treated in apparatus 19 as shown in FIG. 1 without, however, the deflector guides 32. After the yarn was heat set and then tufted forming a carpet and dyed a brown color, a great number of flecks on the order of 10 or more in a 6 inch by 6 inch square of the material were apparent. The flecks were much lighter in color than the dyed carpet (beige as compared to brown) and the carpet was deemed visually unacceptable to customers.

Referring to FIGS. 3–6, a second test was performed on the above-described apparatus of the invention with every step being carried out in the same manner but with the above-described deflector guides 32 in place and utilizing four opposing pairs of deflectors mounted about three inches apart extending lengthwise along the longitudinal extent of the screen 22. The resulting carpet after tufting and dyeing had far fewer flecks, on the order of one tenth as many as the carpet made from material heat set without the deflector guides 32, and was deemed visually acceptable to customers.

The dimensions given of the various parts of the deflector guides 32, their distance apart when a plurality of opposed pairs thereof are utilized and the amount of peripheral sliding movement of a specific point on a loop of strand-like material are given as those preferred in the typical apparatus actually employed and are not meant to be critical to the operation of the invention. One skilled in the art may obviously vary such dimensions so long as the purposes of the inventive apparatus and method are realized.

We claim:

1. A method for heat treating strand-like material whereby substantial irregularities in subsequent dyeing of the material is avoided, said method comprising:

(a) drawing said material from a source;

(b) laying said material in loops which surround and are supported by conveyor means;

(c) conveying said material loops by said conveyor means through a heating zone wherein said material experiences shrinking;

(d) causing certain portions of said loop material to experience substantial peripheral sliding movement in their contact with and with respect to said conveyor means during the time the loops are being conveyed through said heating zone; and (e) drawing said strand-like material off of said conveyor means.

2. The method of claim 1 wherein said conveyor means comprise a plurality of narrow belt or rope conveyor means around which said strand-like material is looped in a spiral coil.

3. The method of claim 1 wherein said loops of material are contacted by guide means mounted in the path of movement of said loops which distort the shape of said loops to cause said substantial peripheral sliding movements of said certain portions of said loop material in contact with and with respect to said conveyor means.

4. The method of claim 3 wherein the guide means which contact said loops of material comprise at least one deflector guide including an elongated loop contacting member positioned in said path of travel of said loops through said heating zone.

5. The method of claim 4 wherein said loops are contacted by at least a pair of said deflector guides mounted on opposing sides of said path of travel of said loops through said heat treating zone.

6. The method of claim 5 wherein said loops are contacted sequentially by a plurality of spaced apart pairs of deflector guides mounted on opposing sides of said path of travel of said loops.

7. Apparatus for heat treating strand-like material whereby substantial irregularities in subsequent dyeing of the material is avoided, said apparatus comprising:

(a) means for drawing said material from a source;

(b) a conveyor means;

(c) means for laying said material in loops which surround and are supported by said conveying means;

(d) means for driving said conveyor means to convey said material loops through a heating zone wherein said material experiences shrinkage;

(e) means for causing certain portions of said loop material to experience substantial peripheral sliding movement in their contact with and with respect to said conveyor means during the time the loops are being conveyed through said heating zone and experiencing shrinking; and (f) means for drawing said material off of said conveying means.

8. The apparatus of claim 7 wherein said conveyor means comprise a plurality of narrow endless belt or rope conveyors around which said strand-like material is looped in a spiral coil.

9. The heat treating apparatus of claim 7 wherein said means for causing said substantial peripheral sliding movement of said certain portions of said loop material in contact with and with respect to said conveyor means comprise at least one guide means mounted in the path of movement of said loops and positioned to contact said loops as they are conveyed through said heating zone to distort the shape of said loops causing said sliding movement.

10. The heat treating apparatus of claim 9 including at least a pair of opposing guide means mounted in the path of movement of said loops and positioned to contact said loops as they are conveyed through said heating zone.

11. The apparatus of claim 10 wherein several pairs of opposing guide means are mounted sequentially in the path of movement of said loops as they are drawn through the heating zone to contact said loops and to sequentially distort the shape of said loops to repeatedly cause said substantial peripheral sliding movement of certain portions of said loop material in contact with and with respect to said conveyor means.

12. The apparatus of claim 9 or 11 wherein each of said guide means comprise a deflector guide having a pair of substantially vertical leg portions, one being slightly longer than the other, an elongated loop contacting member extending between the leg portions and a substantially horizontal member extending between said elongated member and its connected leg portion for spacing said elongated member horizontally inwardly at one end thereof.

13. The apparatus of claim 12 wherein said deflector guide comprises a rounded stainless steel rod bent into the desired shape.

* * * * *

UNITED STATES PATENT AND TRADEMARK OFFICE

CERTIFICATE OF CORRECTION

PATENT NO. : 4,414,756

DATED : November 15, 1983

INVENTOR(S) : C. Simpson, L. Schierl

It is certified that error appears in the above-identified patent and that said Letters Patent is hereby corrected as shown below:

Col. 1, lines 37-38, replace "subsquent" with - - - subsequent - - -.

Col. 1, line 66, after "movement" and before "as" insert - - - in their contact with and with respect to said conveyor means - - -.

Col. 5, line 22, replace "22" with - - - 33 - - -.

Signed and Sealed this

*Thirty-first* Day of *January 1984*

[SEAL]

*Attest:*

GERALD J. MOSSINGHOFF

*Attesting Officer*

*Commissioner of Patents and Trademarks*